US010526849B2

(12) United States Patent
Lin et al.

(10) Patent No.: US 10,526,849 B2
(45) Date of Patent: Jan. 7, 2020

(54) CUTTING STRUCTURE WITH BLADE HAVING MULTIPLE CUTTING EDGES

(71) Applicant: Schlumberger Technology Corporation, Sugar Land, TX (US)

(72) Inventors: Yuanbo Lin, Houston, TX (US); Youhe Zhang, Spring, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 273 days.

(21) Appl. No.: 15/308,237

(22) PCT Filed: Apr. 13, 2015

(86) PCT No.: PCT/US2015/025596
§ 371 (c)(1),
(2) Date: Nov. 1, 2016

(87) PCT Pub. No.: WO2015/167788
PCT Pub. Date: Nov. 5, 2015

(65) Prior Publication Data

US 2017/0058611 A1 Mar. 2, 2017

Related U.S. Application Data

(60) Provisional application No. 61/987,006, filed on May 1, 2014.

(51) Int. Cl.

| | |
|---|---|
| ***E21B 10/32*** | (2006.01) |
| ***E21B 10/26*** | (2006.01) |
| ***E21B 10/43*** | (2006.01) |
| ***E21B 7/28*** | (2006.01) |

(52) U.S. Cl.
CPC ..... *E21B 10/32* (2013.01); *E21B 7/28* (2013.01); *E21B 10/43* (2013.01)

(58) Field of Classification Search
CPC ..... E21B 10/26; E21B 10/32; E21B 10/322
See application file for complete search history.

(56) References Cited

U.S. PATENT DOCUMENTS

| | | | | |
|---|---|---|---|---|
| 7,025,156 | B1 | 4/2006 | Caraway | |
| 9,493,991 | B2 * | 11/2016 | Lyons | E21B 10/32 |
| 2003/0155155 | A1 * | 8/2003 | Dewey | E21B 7/067 175/57 |
| 2007/0205023 | A1 | 9/2007 | Hoffmaster et al. | |
| 2010/0224414 | A1 | 9/2010 | Radford et al. | |
| 2010/0276201 | A1 | 11/2010 | Makkar et al. | |

(Continued)

FOREIGN PATENT DOCUMENTS

WO 2012089999 A2 7/2012

OTHER PUBLICATIONS

International Search Report and Written Opinion for International Application No. PCT/US2015/025596, dated Jul. 17 2015, 12 pages.

*Primary Examiner* — Robert E Fuller

(57) ABSTRACT

A downhole cutting apparatus includes a cutter block having a longitudinal blade. The longitudinal blade includes a first cutting edge adjacent a second cutting edge, and the first cutting edge and the second cutting edge are both either underreaming cutting edges, backreaming cutting edges, or a combination of underreaming and backreaming cutting edges.

20 Claims, 6 Drawing Sheets

(56) References Cited

U.S. PATENT DOCUMENTS

| | | | | |
|---|---|---|---|---|
| 2013/0146361 | A1 | 6/2013 | Makkar et al. | |
| 2014/0048336 | A1* | 2/2014 | Mensa-Wilmot | E21B 10/32 175/266 |

* cited by examiner

CUTTING STRUCTURE WITH BLADE HAVING MULTIPLE CUTTING EDGES

CROSS-REFERENCE TO RELATED APPLICATIONS

This application claims the benefit of, and priority to, U.S. Patent Application Ser. No. 61/987,006, filed on May 1, 2014 and entitled "Downhole Cutting Structure," which application is expressly incorporated herein by this reference.

BACKGROUND

Referring to FIG. 1A, one example of a system for drilling an earth formation is shown. The drilling system includes a drilling rig 10 used to turn a drilling tool assembly 12 that extends into a well bore 14. The drilling tool assembly 12 includes a drill string 16, and a bottomhole assembly (BHA) 18, which is attached to the distal end of the drill string 16. The "distal end" of the drill string is the end furthest from the drilling rig 10.

The drill string 16 includes several joints of drill pipe 16*a* connected end-to-end through tool joints 16*b*. The drill string 16 is used to transmit drilling fluid (through its hollow core) and to transmit rotational power from the drilling rig 10 to the BHA 18. In some cases the drill string 16 further includes additional components such as subs, pup joints, etc.

The BHA 18 includes a drill bit 20. A BHA may also include additional components attached between the drill string 16 and the drill bit 20. Examples of additional BHA components include drill collars, stabilizers, measurement-while-drilling (MWD) tools, logging-while-drilling (LWD) tools, subs, hole enlargement devices (e.g., hole openers and reamers), jars, thrusters, downhole motors, and rotary steerable systems.

In the drilling of oil and gas wells, concentric casing strings are installed and cemented in the well bore as drilling progresses to increasing depths. Each new casing string may run from the surface or may include a liner suspended from a previously installed casing string. The new casing string may be within the previously installed casing string, thereby limiting the annular area available for the cementing operation. Further, as successively smaller diameter casing strings are used, the flow area for the production of oil and gas is reduced. To increase the annular space for the cementing operation, and to increase the production flow area, it may be desirable to enlarge the well bore below the terminal end of the previously cased portion of the well bore. By enlarging the well bore, a larger annular area is provided for subsequently installing and cementing a larger casing string than would have been possible otherwise. Accordingly, by enlarging the well bore below the previously cased portion of the well bore, comparatively larger diameter casing may be used at increased depths, thereby providing more flow area for the production of oil and gas.

Various methods have been devised for passing a drilling assembly through an existing cased portion of a well bore and enlarging the well bore below the casing. One such method is the use of an underreamer, which has basically two operative states—a closed, retracted, or collapsed state, where the diameter of the tool is sufficiently small to allow the tool to pass through the existing cased portion of the well bore, and an open or expanded state, where arms with cutters on the ends thereof extend from the body of the tool. In this latter position, the underreamer enlarges the well bore diameter as the tool is rotated and lowered in the well bore.

SUMMARY

According to one aspect of the disclosure, there is provided, a cutter block including a longitudinal blade. The longitudinal blade includes a first cutting edge adjacent a second cutting edge. The first cutting edge and the second cutting edge are both either underreaming cutting edges or backreaming cutting edges, or both have a combination of underreaming and backreaming cutting edges.

According to another aspect of the disclosure, a method of drilling a well bore includes tripping a drilling tool assembly into a well bore. The drilling tool assembly includes a drill bit and a downhole cutting apparatus. The downhole cutting apparatus includes a cutter block having a longitudinal blade with a first cutting edge adjacent a second cutting edge. A first portion of the well bore is drilled with the drill bit, and a second portion of the well bore is drilled with the downhole cutting apparatus.

According to another aspect of the disclosure, a method of manufacturing a cutter block includes forming a cutter block body having a longitudinal blade with adjacent first and second cutting edges. The first cutting edge and the second cutting edges both have a plurality of cutting element pockets formed therein. The method also includes coupling a plurality of cutting elements to the cutter block body and within the cutting element pockets.

This summary is provided to introduce a selection of concepts that are further described below in the detailed description. This summary is not intended to identify key or essential features of the claimed subject matter, nor is it intended to be used as an aid in limiting the scope of the claimed subject matter.

DETAILED DESCRIPTION

Figure 1A:
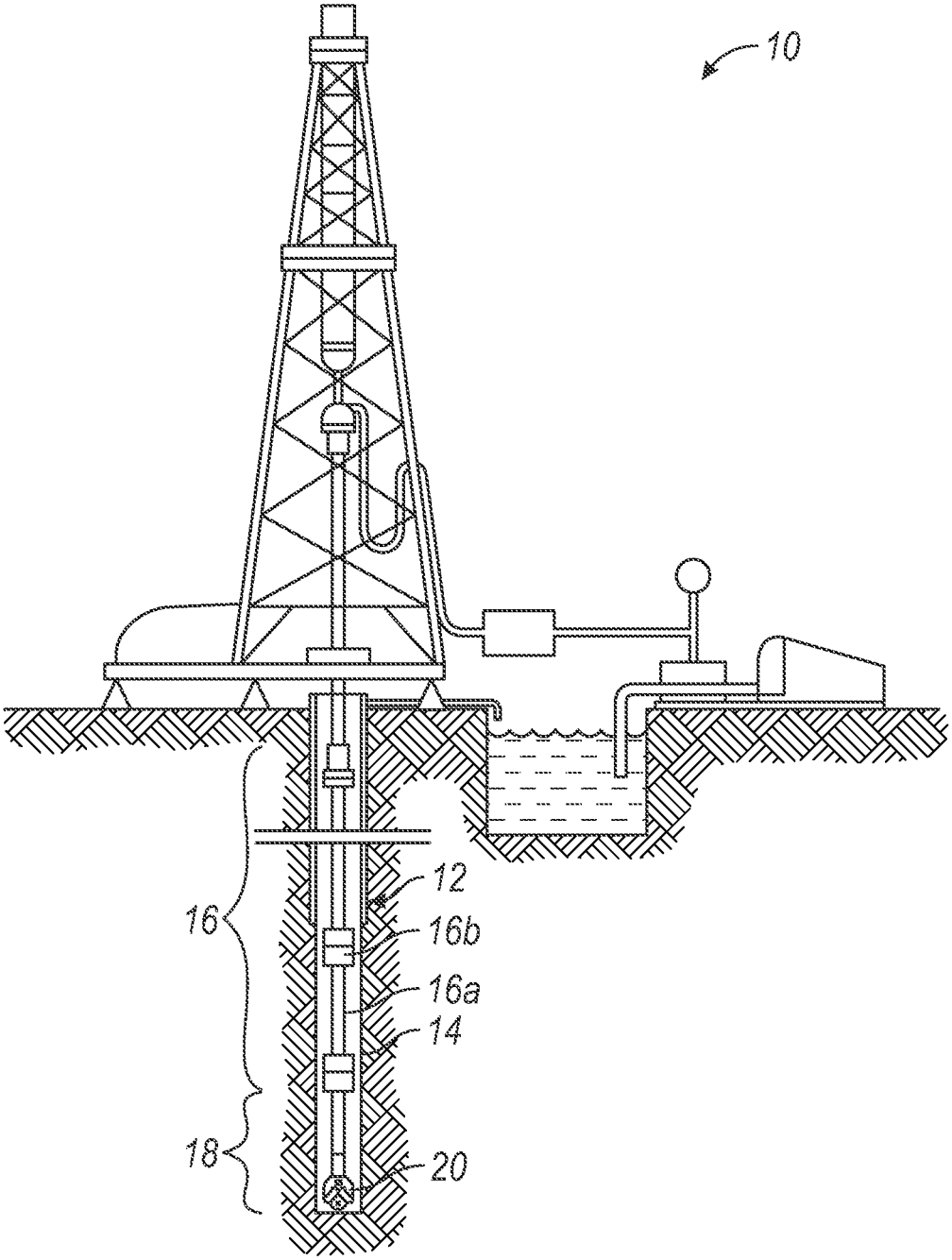
FIG. 1A (Prior Art)
FIG. 1A is a schematic representation of a drilling operation.

In one aspect, embodiments disclosed herein relate generally to cutting structures for use on drilling tool assemblies. More specifically, some embodiments disclosed herein relate to cutting structures having a first and second rows with cutting elements coupled thereto. The first and second rows may each include an underreaming cutting edge and/or a backreaming cutting edge.

The embodiments disclosed should not be interpreted, or otherwise used, as limiting the scope of the disclosure, including the claims to the specific arrangement or features in the disclosed embodiment. Rather, each embodiment may be altered in any number of manners while remaining within the scope of the present disclosure, including by combining features of different embodiments disclosed herein. In addition, those skilled in the art will appreciate that the following description has broad application, and the discussion of any embodiment is meant to be illustrative of that embodiment, and not intended to suggest that the scope of the disclosure, including the claims, is limited to that embodiment.

Certain terms are used throughout the following description and claims to refer to particular features or components. As those skilled in the art will appreciate, different persons may refer to the same feature or component by different names. This document does not intend to distinguish between components or features that differ in name but not function. The figures should be considered as being to scale for some embodiments and not to scale for other embodiments. Further, certain features and components in the drawings may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus should be interpreted to mean "including, but not limited to." Also, the term "couple," "couples," "connects", "connected", "attach", "attaches", "secures", "secured to", and the like are intended to include either an indirect or direct connection, as well as an integral connection. Thus, if a first component is coupled to a second component, that connection may be through a direct connection, or through an indirect connection via other components, devices, and connections.

Reference to up or down will be made for purposes of description with "up", "upper", "uphole", or "upstream" meaning toward the earth's surface or toward the entrance of a well bore; and "down", "lower", "downhole", or "downstream" meaning away from the earth's surface or toward the bottom or terminal end of a well bore.

According to one aspect of the disclosure, there is provided a downhole cutting apparatus, which may include a cutter block having a longitudinal axis defined therethrough. The cutter block may have a first row of cutting elements and a second row of cutting elements coupled thereto. The first row may have an underreaming cutting edge and a backreaming cutting edge, and the second row may have an underreaming cutting edge and a backreaming cutting edge. In some embodiments, the first row may be radially outward relative to the second row, in relation to the longitudinal axis. In one or more embodiments, the downhole cutting apparatus may be an expandable tool and the cutter block may be radially extendable from a tubular body of the expandable tool. In one or more other embodiments, the downhole cutting apparatus may be a downhole cutting tool that is not expandable. For example, in one or more embodiments, the downhole cutting apparatus may be a downhole reamer or hole opener having a cutter block that does not expand radially.

Figure 1B:
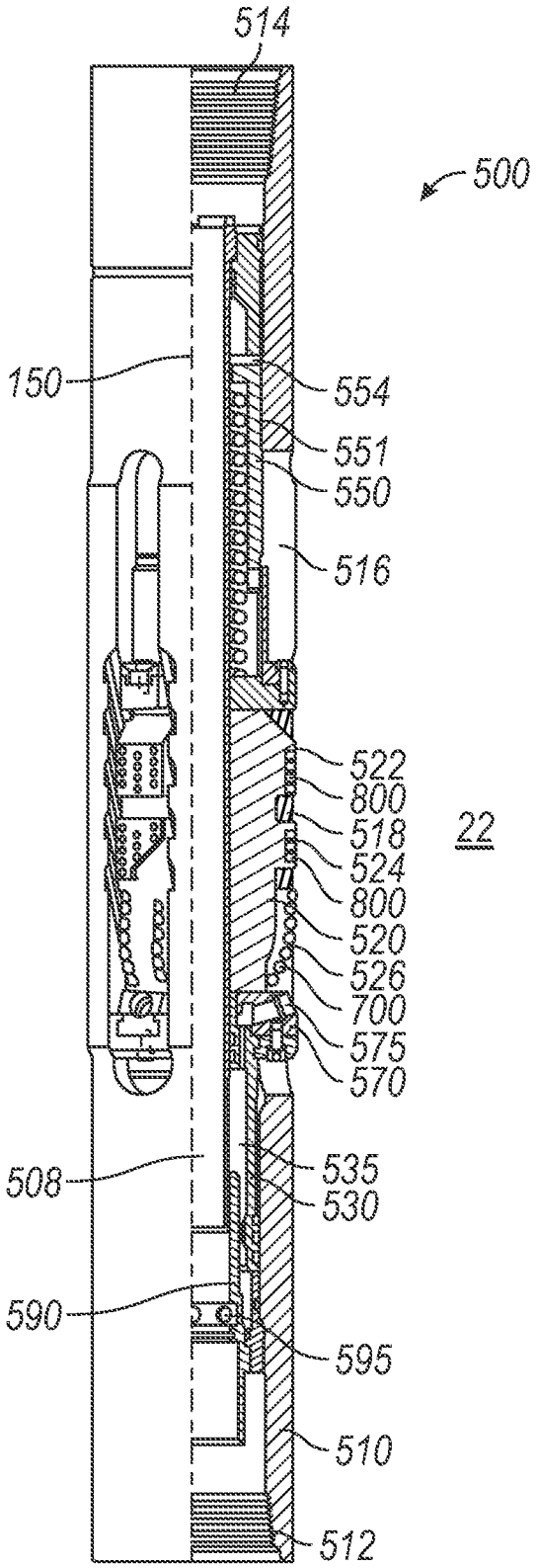
FIGS. 1B and 1C are partial cut-away views of an expandable cutting structure in accordance with embodiments disclosed herein.
Figure 1C:
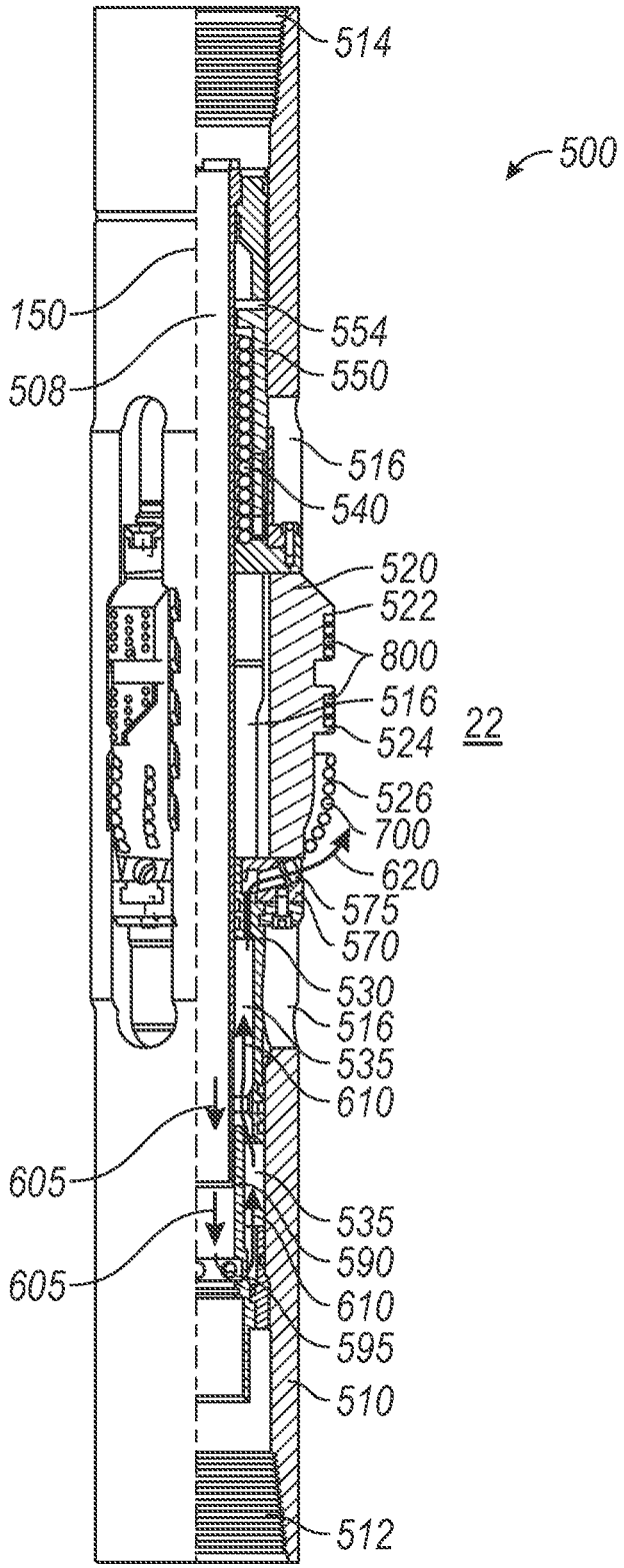

Referring to FIGS. 1B and 1C, an expandable tool, which may be used in embodiments of the present disclosure, generally designated as 500, is shown in a collapsed position in FIG. 1B and in an expanded position in FIG. 1C. The expandable tool 500 may include a generally cylindrical tubular tool body 510 with a flowbore 508 extending therethrough and a longitudinal axis 150 defined therethrough. As shown, the tool body 510 may include an upper connection portion 514 and a lower connection portion 512 for coupling the expandable tool 500 to a drill string, BHA, or other drilling assembly. Further, as shown, one or more recesses 516 may be formed in the tool body 510, and optionally at approximately the axial center of the tool body 510. The one or more recesses 516 may be spaced apart azimuthally around the circumference of the tool body 510. The one or more recesses 516 may accommodate the axial movement of several components of the expandable tool 500 that move axially up or down within the recesses 516, including one or more moveable tool arms, such as cutter blocks 520. The cutter blocks 520 520 may be non-pivotable in some embodiments, but movable tool arms may pivot in other embodiments. Each recess 516 may store one cutter block 520 in the collapsed position.

FIG. 1C shows the expandable tool 500 with the cutter blocks 520 in an expanded position (e.g., a maximum expanded position), extending radially outwardly from the tool body 510. Once the expandable tool 500 is in the well bore, one or more of the cutter blocks 520 may be expandable to one or more radial positions. The expandable tool 500 may therefore have at least two operational positions—including at least a collapsed position as shown in FIG. 1B and an expanded position as shown in FIG. 1C. In other embodiments, the expandable tool 500 may have multiple operational positions where the cutter blocks 520 are between fully retracted and fully expanded states. In some embodiments, a spring retainer 550, which may include a threaded sleeve, may be adjusted at the surface or using a downhole drive system, to limit the full diameter expansion of the cutter blocks 520. The spring retainer 550 may compress a biasing spring 540 when the expandable tool 500 is collapsed, and the position of the spring retainer 550 may determine the amount of expansion of the cutter blocks 520. The spring retainer 550 may be adjusted by a wrench (not shown) in a wrench slot 554 that may rotate the spring retainer 550 axially downwardly or upwardly with respect to the tool body 510 at the threads 551.

In the expanded position shown in FIG. 1C, the cutter blocks 520 may perform one or more of underreaming the well bore, backreaming the well bore, or stabilizing the drilling assembly within the well bore. The operations performed may depend on the configuration of the cutter blocks 520, including one or more pads 522, 524 and other surfaces (e.g., surface 526). In some embodiments, the cutter blocks 520 may have configurations as further discussed herein. Hydraulic force may cause the cutter blocks 520 to expand radially outwardly (and optionally to move axially upwardly) to the position shown in FIG. 1C due to the differential pressure of the drilling fluid between the flowbore 508 and the well bore annulus 22.

In one or more embodiments, optional depth of cut limiters 800 on pad 522 and/or pad 524 may be formed from polycrystalline diamond, tungsten carbide, titanium carbide, cubic boron nitride, other superhard materials, or some combination of the foregoing. Depth of cut limiters 800 may include inserts with cutting capacity, such as back up cutters, diamond impregnated inserts with less exposure than primary cutting elements, diamond enhanced inserts, tungsten carbide inserts, semi-round top inserts, or other inserts that may or may not have a designated cutting capacity. Optionally, the depth of cut limiters 800 may not primarily engage formation during reaming; however, after wear of primary cutting elements, depth of cut limiters 800 may engage the formation to protect the primary cutting elements from increased loads as a result of worn primary cutting elements. In one or more embodiments, depth of cut limiters 800 may be positioned behind, i.e., above or uphole from, primary cutting elements at a selected distance, such that depth of cut limiters may remain unengaged with formation until wear of other cutting elements occurs. Depth of cut limiters 800, as described herein, may aid in maintaining a desired well bore gauge by providing increased structural integrity to the cutter block 520.

Drilling fluid may flow along path 605, through ports 595 in a lower retainer 590, along path 610 into the piston chamber 535. The differential pressure between the fluid in the flowbore 508 and the fluid in the well bore annulus 22 surrounding expandable tool 500 may cause the piston 530 to move axially upwardly from the position shown in FIG. 1B to the position shown in FIG. 1C. A small amount of flow can move through the piston chamber 535 and through nozzles 575 to the well bore annulus 22 as the cutter blocks 520 of the expandable tool 500 start to expand. As the piston 530 moves axially upwardly in recesses 516, the piston 530 engages the drive ring 570, thereby causing the drive ring 570 to move axially upwardly against the cutter blocks 520. The cutter blocks 520 will move axially upwardly in recesses 516 and also radially outwardly as the cutter blocks 520 travel in channels 518 in or on the tool body 510. In the expanded position, the flow continues along paths 605, 610 and out into the well bore annulus 22 through nozzles 575. The nozzles 575 may be part of the drive ring 570, and may therefore move axially with the cutter blocks 520. Accordingly, these nozzles 575 are optimally positioned to continuously provide cleaning and cooling to the cutting elements 700 on surface(s) 526 as fluid exits to the well bore annulus 22 along flow path 620.

The expandable tool 500 may be designed to remain generally concentric with the well bore. In particular, expandable tool 500, in one embodiment, may include three extendable cutter blocks 520 spaced apart circumferentially at the same axial location on the tool body 510. In some embodiments, the circumferential spacing may be approximately 120°. This three-arm design may provide a full gauge expandable tool 500 that remains centralized in the well bore. Embodiments disclosed herein are not limited to tool embodiments having three extendable cutter blocks 520. For example, in one or more embodiments, the expandable tool 500 may include different configurations of circumferentially spaced cutter blocks or other types of arms, for example, one arm, two arms, four-arms, five-arms, or more than five-arm designs. Thus, in specific embodiments, the circumferential spacing of the arms may vary from the 120° spacing illustrated herein. For example, in alternate embodiments, the circumferential spacing may be 90°, 60°, or the cutter blocks 520 may be circumferentially spaced in non-equal increments. Further, in some embodiments, one or more of the cutter blocks 520 may be axially offset from one or more other cutter blocks 520. Accordingly, the cutting structure designs disclosed herein may be used with any number of cutting structures and tools.

In one or more embodiments, a cutter block may include a longitudinal blade having a longitudinal axis defined therethrough. The longitudinal blade may include a first cutting edge adjacent a second cutting edge. The first cutting edge and the second cutting edge may both be either underreaming cutting edges or backreaming cutting edges.

Figure 2A:
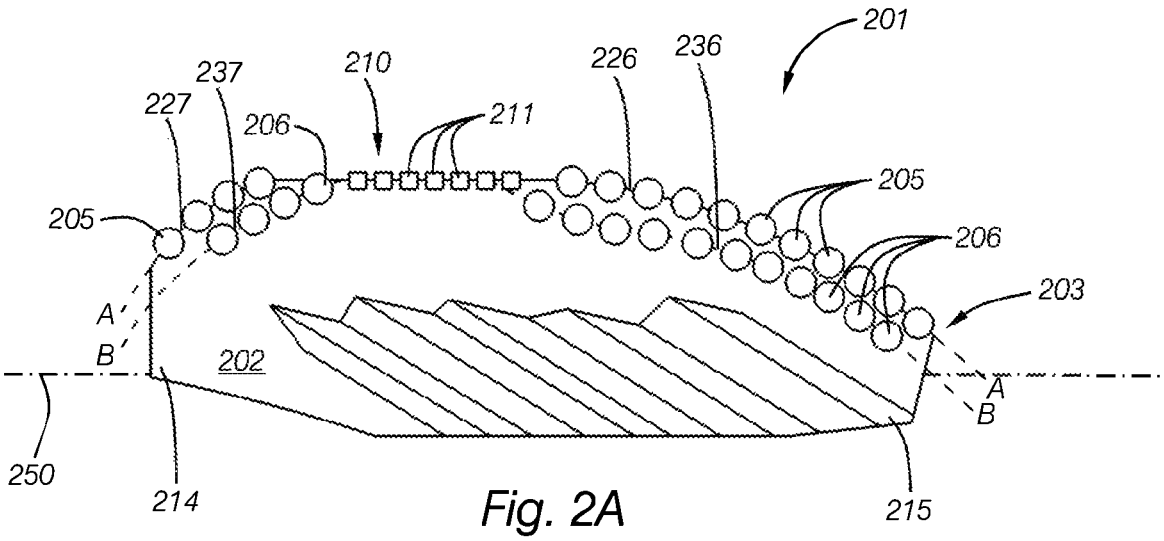
FIG. 2A is a side view of a cutter block in accordance with embodiments disclosed herein.

For example, FIG. 2A is a side view of a cutter block 201 according to embodiments described herein. As shown, the cutter block 201 may include a body 202 having a longitudinal axis 250 defined therethrough. The cutter block 201 may further include a downhole end 215, an uphole end 214, and a longitudinal blade 203. The cutter block 201 also may include a first cutting edge, which may be a contour defined by dotted line A. An optional second cutting edge, which may be a contour defined by dotted line B, may be formed on the longitudinal blade 203 adjacent the first cutting edge. In one or more embodiments, the body 202 may be formed from a metal material, a matrix material, other materials, or a combination of the foregoing. For instance, the body 202 may be include steel, tungsten carbide, titanium carbide, or any other material known in the art.

The cutter block 201 may be configured to be coupled to a downhole tool (e.g., the expandable tool 500 having a tubular body 510 shown in FIGS. 1B and 1C). In one or more embodiments, the downhole end 215 of the cutter block 201 may be further downhole than the uphole end 214 of the cutter block 201 when the cutter block 201 is coupled to the downhole tool and within a well bore. In one or more embodiments, the cutter block 201 may have a plurality of cutting elements 205 on, in, or otherwise coupled to the first cutting edge A, and a plurality of cutting elements 206 on, in, or otherwise coupled to the second cutting edge B. In one or more embodiments, the cutting elements 205, 206 may be formed from tungsten carbide, polycrystalline diamond, cubic boron nitride, or other materials. The cutting elements 700 may be formed from any material known in the art.

As shown, the first cutting edge A of the cutter block 201 may include an underreaming cutting edge 226 and a backreaming cutting edge 227. In at least some embodiments, the second cutting edge B of the cutter block 201 may include an underreaming cutting edge 236 and a backreaming cutting edge 237. At least one of the underreaming cutting edge 226 of the first cutting edge A or the underreaming cutting edge 236 of the second cutting edge B may be used to cut a portion of a well bore during an underreaming operation. Further, at least one of the backreaming cutting edge 227 of the first cutting edge A or the backreaming cutting edge 237 of the second cutting edge B may be used to cut a portion of a well bore during a backreaming operation. Both an underreaming operation and a backreaming operation may be considered a drilling operation.

Further, as shown, the cutting elements 205, 206 coupled to the cutter block 201 may be arranged such that one or more cutting elements 206 on the second cutting edge B may be between one or more cutting elements 205 on the first cutting edge A. As used herein, the term "between" when referring to one or more cutting elements refers to a position or space between adjacent cutting elements in a cutting edge of the cutter block 201. For example, one of the cutting elements 206 of the second cutting edge B may be considered to be between two of the cutting elements 205 of the first cutting edge A if a portion of the cutting element 206 of the second cutting edge B fully or partially occupies a space between the two cutting elements 205 of the first cutting edge A. In at least some embodiments, a cutting element 206 that is between cutting elements 205 may be at least partially longitudinally or axially offset from the cutting elements 205.

In one or more embodiments, the cutting elements 205 on the first cutting edge A may be substantially equivalent to the cutting elements 206 on the second cutting edge B. In the same or other embodiments, the size, shape, material make-up, or other configuration of the cutting elements 205 on the first cutting edge A may be different than that of the cutting elements 206 on the second cutting edge B. In some embodiments, the cutting elements 205 on the first cutting edge A may each be substantially equivalent; however, in other embodiments at least some of the cutting elements 205 may have different configurations. Similarly, the cutting elements 206 on the second cutting edge B may be substantially equivalent or may be different. According to embodiments disclosed herein, the size of a cutting element may refer to a diameter, height, circumference, radius, perimeter, or other dimension of a cutting element. Further, according to some embodiments, the shape of a cutting element may refer to an outer contour/profile of the cutting element, including a shape of a top shear or impact surface, a side surface, a base surface, a chamfer, or the like. Furthermore, the material make-up of a cutting element may refer to the materials used to form the cutting element and/or the materials contained within the cutting element.

Although it may be desired in some embodiments for the cutting elements 205, 206 to be exactly equal in size, shape, and material make-up, exactly equal size, shape, and material make-up may be difficult to actually achieve in practice. As such, minor variations, including at least manufacturing tolerances, between the size, shape, and material make-up of each of the cutting elements 205, 206 may be within the meaning of the phrases "substantially equal" or "substantially equivalent" as used herein.

In one or more embodiments, at least a portion of the first cutting edge A may be radially outward from the second cutting edge B relative to the longitudinal axis 250. For example, as shown, at least a portion of the first cutting edge, is farther away from the longitudinal axis 250 as compared to at least a portion of the second cutting edge B. In other words, at least a portion of the second cutting edge B may be closer to the longitudinal axis 250 than at least a portion of the first cutting edge A. Said another way, at least a portion of the second cutting edge B is radially inward of at least a portion of the first cutting edge A.

Further, in one or more embodiments, the first cutting edge A may be rotationally or laterally offset from the second cutting edge B. Such an offset may also be referred to herein as a "circumferential" offset. The term "circumferential" refers to a circumference or perimeter of a downhole tool (e.g., the expandable tool 500 shown in FIGS. 1B and 1C), having the cutter block 201 thereon. In some embodiments, if the first cutting edge A is circumferentially offset from the second cutting edge B, both the first cutting edge A and the second cutting edge B may extend along an axial or longitudinal length of the cutter block 201 (e.g., generally in the direction of the longitudinal axis 250), and as the downhole tool rotates the first cutting edge A or second cutting edge B (depending on the direction of rotation), may be in a leading position to engage a portion of formation before the other. A lateral or rotational offset of cutting edges A, B (or multiple blades as discussed herein), may be considered a "circumferential" offset despite not being coupled to a downhole tool where the cutting edges or blades would be circumferentially offset if they were coupled to a downhole tool.

Optionally, the first cutting edge A and the second cutting edge B do not intersect. In one or more embodiments, however, the first cutting edge A and the second cutting edge B may be considered to be circumferentially offset despite the first cutting edge A and the second cutting edge B intersecting, overlapping, or otherwise sharing a portion of the cutter block 201. For instance, a portion of the first cutting edge A may be circumferentially offset from a portion of the second cutting edge B. As an example, although the first cutting edge A may be circumferentially offset from the second cutting edge B, in some embodiments, a plane extending radially from the longitudinal axis 250 may intersect one or more cutting elements 205, 206 of both the first cutting edge A and the second cutting edge B. In such an embodiment, partial circumferential overlap may exist between one or more cutting elements 205 of the first cutting edge A and one or more cutting elements 206 the second cutting edge B.

Figure 2B:
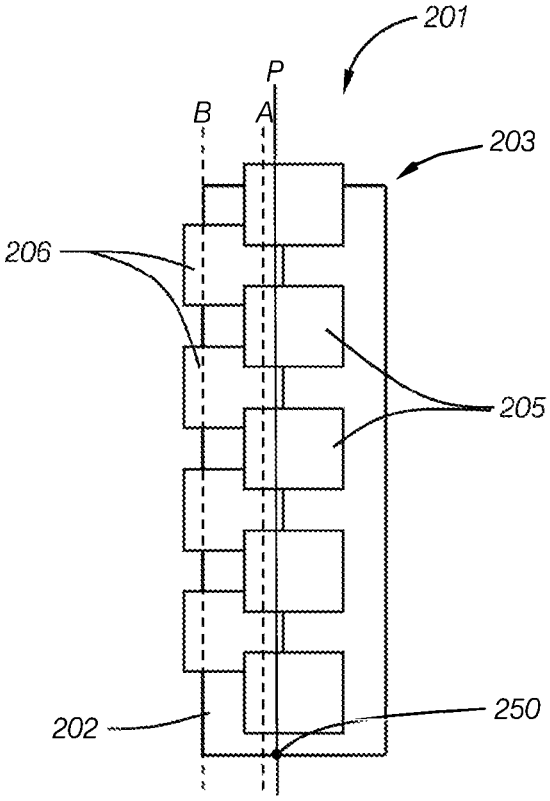
FIG. 2B is a front view of a cutter block in accordance with embodiments disclosed herein.

Referring to FIG. 2B, a front view of a cutter block 201 is shown in accordance with embodiments of the present disclosure. As shown, the cutter block 201 may be viewed from the downhole end 215, and may include a body 202 having a longitudinal blade 203 with a longitudinal axis 250. The cutter block 201 may include a first cutting edge A adjacent a second cutting edge B. As shown, the first cutting edge A has cutting elements 205 thereon, and the second cutting edge B has cutting elements 206 thereon. Further, as shown, the first cutting edge A may be circumferentially offset from the second cutting edge B in one or more embodiments. For instance centers of the cutting elements 205 may be circumferentially offset from centers of the cutting elements 206. In some embodiments, however, a plane, which may be defined by an arrow P, extending radially from the longitudinal axis 250 defined through the longitudinal blade 203 of the cutter block 201 may intersect one or more cutting elements 205, 206 of both the first cutting edge A and the second cutting edge B. In other words, the plane P may intersect both the cutting elements 205 of the first cutting edge A and the cutting elements 206 of the second cutting edge B.

Furthermore, in one or more embodiments, a height of an apex of the first cutting edge A may be substantially equal to a height of an apex of the second cutting edge B. The term "apex" of a cutting edge of the cutter block 201, as used herein, may refer to a point of the cutting edge of the cutter block 201, e.g., the first cutting edge A or the second cutting edge B, which is furthest from the longitudinal axis 250.

For example, referring back to FIG. 2A, the apex of the first cutting edge A of the cutter block 201 may be a point or portion of the first cutting edge A that is farther away from the longitudinal axis 250 than any other point or portion of the first cutting edge A of the cutter block 201. Similarly, the apex of the second cutting edge B of the cutter block 201 may be a point or portion of the second cutting edge B of the cutter block 201 that is farther away from the longitudinal axis 250 than any other point or portion of the second cutting edge B of the cutter block 201. As such, in one or more embodiments, the apex of the first cutting edge A and the apex of the second cutting edge B may be the same point, the same axial position, or within the same portion of the cutter block 201. Accordingly, in one or more embodiments, the apex of the first cutting edge A and the apex of the second cutting edge B may be said to be at the same point or even at the same height from the longitudinal axis 250.

In one or more embodiments, the longitudinal blade 203 may include a stabilizer pad 210 thereon. As shown, the stabilizer pad 210 may form a portion of the first cutting edge A. In the same or other embodiments, the stabilizer pad 210 may form a portion of the second cutting edge B. Optionally, the stabilizer pad 210 may be located at, or adjacent, an apex of the first and/or second cutting edges A, B.

In one or more embodiments, the stabilizer pad 210 may include at least one depth of cut limiter 211 thereon, therein, or otherwise coupled thereto. In one or more embodiments, depth of cut limiters 211 may include inserts with cutting capacity, such as back-up cutters or diamond impregnated inserts with less exposure than primary cutting elements (e.g., the cutting elements 205 and/or 206). Depth of cut limiters 211 may include diamond enhanced inserts, tungsten carbide inserts, gauge protection elements, domed inserts, semi-round top inserts, conical inserts, frusto-conical inserts, ridged inserts, or other inserts. In some embodiments, the depth of cut limiters 211 may not have a designated cutting capacity. In one or more embodiments, depth of cut limiters 211 may be radially inside other cutting elements 205, 206. For instance, the depth of cut limiters 211 may extend radially outward from the longitudinal axis 250 an amount less than a distance of at least one of the cutting elements 205, 206 such that depth of cut limiters 211 may remain unengaged with formation until wear of one or more primary cutting elements 205, 206 occurs. In other embodiments, the radially outer position of the depth of cut limiters 211 may be radially outward of some or potentially each cutting element 205, 206.

The stabilizer pad 210 may aid in maintaining well bore gauge, maintaining a gauge of the cutter block 201, stabilizing a downhole cutting apparatus (e.g., the expandable tool 500 shown in FIGS. 1B and 1C) while downhole, in other actions, or any combination of the foregoing. For example, the stabilizer pad 210 may provide a surface of a downhole cutting apparatus to contact a surface of the well bore, which may aid in stabilizing the downhole cutting apparatus in downhole conditions. Further, the stabilizer pad 210 having at least one depth of cut limiter 211 that may aid in maintaining well bore and/or downhole cutting apparatus gauge. For example, in one or more embodiments, a diameter of the downhole cutting apparatus may be defined by the apex of the cutter block 201, which may be the stabilizer pad 210. Depth of cut limiters 211 that facilitate maintaining gauge of a well bore and/or of the downhole cutting apparatus may be referred to as gauge protection elements.

As shown in FIG. 2A, the apex of the first cutting edge A (which may also be the gauge of the first cutting edge A) may be defined by, located on, or be adjacent, an outer surface of the stabilizer pad 210. For instance, the apex of the first cutting edge A may include at least a first portion of the stabilizer pad, or be adjacent a first portion of the stabilizer pad 210. Further, the apex of the second cutting edge B (which may also be the gauge of the second cutting edge B) may be defined by, located on, or be adjacent, an outer surface of the stabilizer pad 210. For instance, the apex of the second cutting edge B may include at least a first portion of the stabilizer pad, or be adjacent a first portion of the stabilizer pad 210. In other embodiments, the apex or gauge of the first cutting edge A and/or the second cutting edge B may not be adjacent a stabilizer pad 210.

In some embodiments, the stabilizer pad 210 may form a portion of both the first cutting edge A and the second cutting edge B of the cutter block 201. An outer surface of the stabilizer pad 210 may be the point or portion of the cutter block 201 that is farthest away from the longitudinal axis 250. As such, the gauge of a well bore being drilled with the cutter block 201 may be defined by, or correspond to, the stabilizer pad 210 and may be maintained by the stabilizer pad 210 and the at least one depth of cut limiter 211 coupled to the stabilizer pad 210.

In some embodiments, having at least a portion of the first cutting edge A of the cutter block 201 radially outward from the second cutting edge B of the cutter block 201 relative to the longitudinal axis 250 may provide protection to the cutting elements 206 on the second cutting edge B. For example, because the first cutting edge A having the cutting elements 205 may be farther away from the longitudinal axis 250 than the second cutting edge B having the cutting elements 206, the cutting elements 205 may contact a well bore formation before the cutting elements 206. Further, if the cutting elements 205 of the first cutting edge A, e.g., the underreaming cutting edge 226 and/or the backreaming cutting edge 227 of the first cutting edge A, were to fail and be worn or destroyed, the cutting elements 206 of the second cutting edge B, e.g., the underreaming cutting edge 236 and/or the backreaming cutting edge 237 of the second cutting edge B, may drill in place of the first cutting edge A and may allow the drilling operation to continue without stopping the drilling operation to remove the cutter block 201 from the well bore.

Furthermore, because, in one or more embodiments, the stabilizer pad 210 may be the apex or gauge of both the first cutting edge A and the second cutting edge B, the gauge of the well bore being drilled by the cutting elements 205 of the first cutting edge A and/or the cutting elements 206 of the second cutting edge B may be maintained and may remain constant despite the possibility of the cutting elements 205 of the first cutting edge A, e.g., the cutting elements 205 on the underreaming cutting edge 226 and/or the backreaming cutting edge 227, being destroyed during use downhole.

Figure 2C:
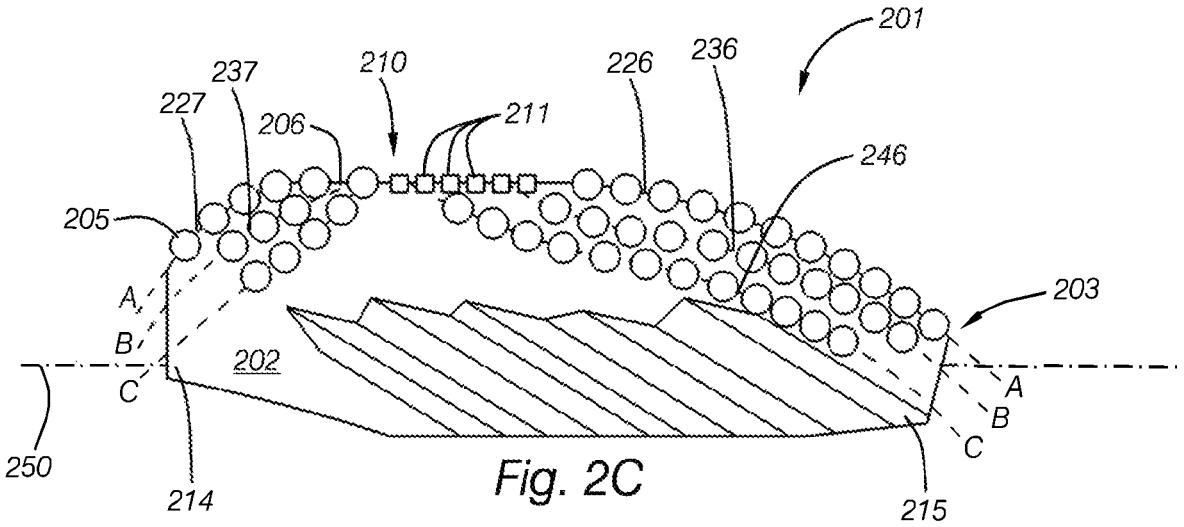
FIG. 2C is a side view of a cutter block in accordance with embodiments disclosed herein.

Embodiments of the present disclosure are not limited to cutter blocks having two cutting edges formed thereon, or any of the particular features shown in FIGS. 2A and 2B. For example, referring to FIG. 2C, a side view of the cutter block 201 is shown having three cutting edges. As shown, the cutter block 201 includes a third cutting edge, defined by the dotted line C. In one or more embodiments, at least a portion of the third cutting edge C may be radially inward of both the first cutting edge A and the second cutting edge B, relative to the longitudinal axis 250. In other words, in one or more embodiments, at least a portion the first cutting edge A may be radially outward of the second cutting edge B with respect to the longitudinal axis 250, and at least a portion of the second cutting edge B may be radially outward of the third cutting edge C with respect to the longitudinal axis 250.

As shown, each of the first cutting edge A, the second cutting edge B, and the third cutting edge C have cutting elements 205 coupled thereto. As discussed herein, however, according to some embodiments, cutting elements 205 of the first cutting edge A, the second cutting edge B, and the third cutting edge C may differ in size, shape, material make-up, or in other configuration, relative to cutting elements 205 on the same or other cutting edges A, B, C. Further, in one or more embodiments, one or more of the cutting edges A, B, C of the cutter block 201 (and potentially each cutting edge A, B, C) may include a combination of cutting elements 205 that differ in size, shape, material make-up, or other configuration.

As shown, the third cutting edge C may include an underreaming cutting edge 246 and a backreaming cutting edge 247, which may be used to carry out underreaming and backreaming operations, respectively. Further, as shown, the stabilizer pad 210 may form or define at least a portion of the third cutting edge C. As such, an apex (or gauge) of the third cutting edge C may be defined by the outer surface of the stabilizer pad 210.

During a drilling operation, if the cutting elements 205 of the first cutting edge A (e.g., the underreaming cutting edge 226 and/or the backreaming cutting edge 227 of the first cutting edge A), and the cutting elements 205 of the second cutting edge B (e.g., the underreaming cutting edge 236 and/or the backreaming cutting edge 237 of the second cutting edge B), were to fail and be worn or destroyed, the cutting elements 205 of the third cutting edge C (e.g., the underreaming cutting edge 246 and/or the backreaming cutting edge 247 of the third cutting edge C), may drill in place of the first cutting edge A and the second cutting edge B. This may allow the third cutting edge C to act as a back-up cutting edge, and may allow the drilling operation to continue without stopping the drilling operation to remove the cutter block 201 from the well bore.

In some embodiments, a cutter block 201 of the present disclosure may therefore allow a drilling operation (e.g., an underreaming operation and/or a backreaming operation) to continue even if an underreaming cutting edge or backreaming cutting edge fails and is worn and destroyed. The drilling operation may continue without removing the downhole tool from the well bore and replacing the cutter block 201. Further, the cutter block 201 may allow the drilling operation to continue if an underreaming cutting edge or backreaming cutting edge fails and is worn and destroyed without having to rely on deployment (e.g., mechanical deployment) of a replacement cutting edge or replacement cutter block from one or more downhole tools. In some embodiments, the cutter block 201 may be monolithic.

Figure 2D:
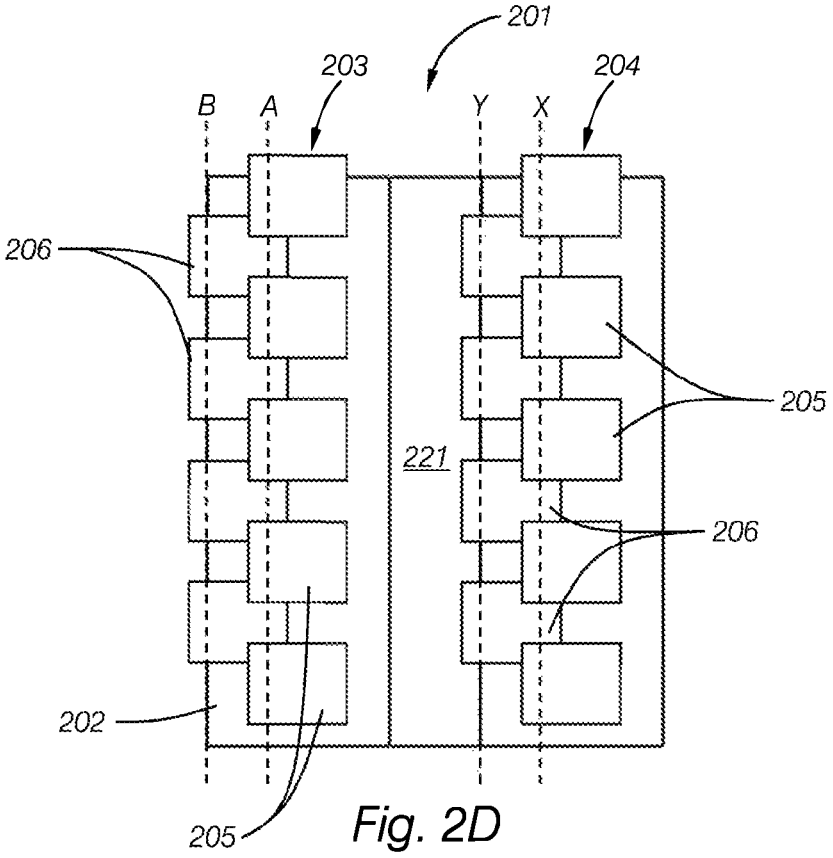
FIG. 2D is a side view of a cutter block in accordance with embodiments disclosed herein.

In one or more embodiments, as shown in FIG. 2D, the cutter block 201 may also include a second longitudinal blade 204. The second longitudinal blade 204 may include a first cutting edge X adjacent a second cutting edge Y, in which the first cutting edge X and the second cutting edge Y are both either underreaming cutting edges, are both backreaming cutting edges, or include both underreaming and backreaming cutting edges. In at least some embodiments, a flow channel 221 may be formed between first and second longitudinal blades 203, 204. Optionally, the first and second longitudinal blades 203, 204 may be substantially equivalent (e.g., have cutting elements 205, 206 at substantially equivalent positions radial and longitudinal positions); however, in other embodiments the first and second longitudinal blades 203, 204 may be different.

Figure 3A:
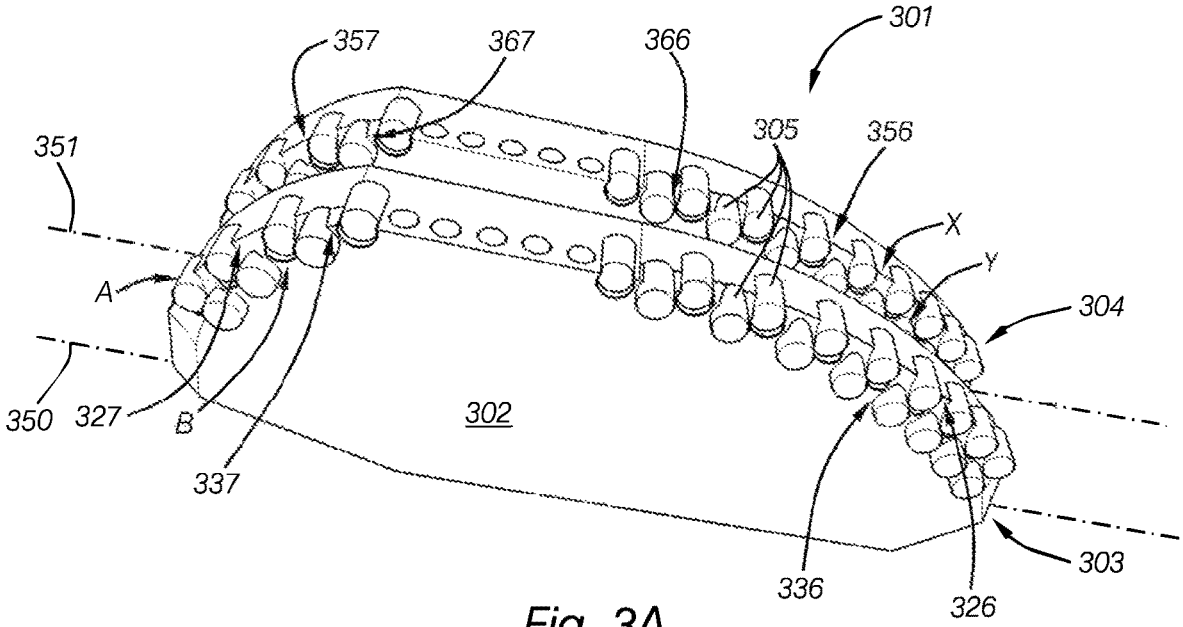
FIG. 3A is a perspective view of a cutter block in accordance with embodiments disclosed herein.

FIG. 3A is a side view of another example cutter block 301 in accordance with embodiments of the present disclosure. As shown, the cutter block 301 may include a body 302 having a first longitudinal blade 303 and a second longitudinal blade 304. A longitudinal axis 350 may extend through the first longitudinal blade 303, and a longitudinal axis 351 may extend through the second longitudinal blade 304.

The cutter block 301 may be configured to be coupled to a downhole tool (e.g., the expandable tool 500 shown in FIGS. 1B and 1C). As shown, the first longitudinal blade 303 includes a first cutting edge, defined by contour A, and a second cutting edge, defined by contour B. Further, as shown, the second longitudinal blade 304 includes a first cutting edge, defined by contour X, and a second cutting edge, defined by contour Y. The cutting edges of both the first longitudinal blade 203 and the second longitudinal blade 204 may have one or more cutting elements 305 coupled thereto. In one or more embodiments, the first cutting edge A and the second cutting edge B of the first longitudinal blade 303 may both either be underreaming cutting edges or backreaming cutting edges, or both be a combination of underreaming and backreaming cutting edges. Further, in one or more embodiments, the first cutting edge X and the second cutting edge Y of the second longitudinal blade 304 may both either be underreaming cutting edges or backreaming cutting edges, or both be a combination of underreaming and backreaming cutting edges. For instance, as shown, the first cutting edge A of the first longitudinal blade 303 may include an underreaming cutting edge 326, and the second cutting edge B of the first longitudinal blade 303 includes an underreaming cutting edge 336. Moreover, the first cutting edge A of the first longitudinal blade 303 may include a backreaming edge 327, and the second cutting edge B of the first longitudinal blade 303 may include a backreaming edge 337. In one or more embodiments, the first cutting edge X of the second longitudinal blade 304 may include an underreaming cutting edge 356, and the second cutting edge Y of the second longitudinal blade 304 may include an underreaming cutting edge 366. Furthermore, the first cutting edge X of the second longitudinal blade 304 may include a backreaming edge 357, and the second cutting edge Y of the second longitudinal blade 304 may include a backreaming edge 367.

In one or more embodiments, at least a portion of the first cutting edge A of the first longitudinal blade 303 may be radially outward of at least a portion of the second cutting edge B of the first longitudinal blade 303 relative to the longitudinal axis 350, similar to the discussion herein of cutting edges A, B in reference to FIG. 2A. For instance, the average radial position of the first cutting edge A relative to the longitudinal axis 350 may be greater than the average radial position of the second cutting edge B relative to the longitudinal axis 350. In the same or other embodiments, at each longitudinal position of the first and second cutting edges A, B, the radial position of the first cutting edge A (except for potentially an apex or stabilizer pad) may be radially outward of the radial position of the cutting edge B. Similarly, in one or more embodiments, at least a portion of the first cutting edge X of the second longitudinal blade 304 may be radially outward of at least a portion of the second cutting edge Y of the second longitudinal blade 304 relative to the longitudinal axis 351. In the same or other embodiments, at each longitudinal position of the first and second cutting edges X, Y, the radial position of the first cutting edge X (except for potentially an apex or stabilizer pad) may be radially outward of the radial position of the cutting edge Y.

Further, in one or more embodiments, the first cutting edge A of the first longitudinal blade 303 may be at least partially circumferentially offset from the second cutting edge B of the first longitudinal blade 303. Similarly, in one or more embodiments, the first cutting edge X of the second longitudinal blade 304 may be at least partially circumferentially offset from the second cutting edge Y of the second longitudinal blade 304. The first blade 303 may also be circumferentially offset from the second blade 304.

As discussed herein, although the first cutting edge A of the first longitudinal blade 303 may be circumferentially offset from the second cutting edge B of the first longitudinal blade 303, a plane extending radially from the longitudinal axis 350 of the first longitudinal blade 303 may, in some embodiments, intersect one or more cutting elements 305 of both the first cutting edge A and the second cutting edge B of the first longitudinal blade 303. In other embodiments, such a plane may not intersect cutting elements 305 of both cutting edges A, B. Similarly, although the first cutting edge X of the second longitudinal blade 304 may be circumferentially offset from the second cutting edge Y of the second longitudinal blade 304, a plane extending radially from the longitudinal axis 351 of the second longitudinal blade 304 may optionally intersect one or more cutting elements 305 of both the first cutting edge X and the second cutting edge Y of the second longitudinal blade 304.

In one or more embodiments, a height of an apex of the first cutting edge A of the first longitudinal blade 303 (i.e., the gauge of the first cutting edge A) may be substantially equal to a height of an apex of the second cutting edge B of the first longitudinal blade 303 (i.e., the gauge of the second cutting edge B). Further, in one or more embodiments, a height of an apex of the first cutting edge X of the second longitudinal blade 304 may be substantially equal to a height of an apex of the second cutting edge Y of the second longitudinal blade 304.

In one or more embodiments, a height of an apex of the first longitudinal blade 303 may be substantially equal to a height of an apex of the second longitudinal blade 304. The first and second longitudinal blades 303, 304 may therefore have the same gauge. In one or more embodiments, however, a height of an apex of the first longitudinal blade 303 may different from a height of an apex of the second longitudinal blade 304. For example, in one or more embodiments, the height of the apex of the first longitudinal blade 303 may be greater than the height of the apex of the second longitudinal blade 304, or vice versa. In other words, the distance between the outermost point of the first longitudinal blade 303 and the longitudinal axis 350 (or a longitudinal axis of the downhole tool or well bore) may be greater than the distance between the outermost point of the second longitudinal blade 304 and the longitudinal axis 351 (or a longitudinal axis of the downhole tool or well bore), or vice versa. As such, in one or more embodiments, a cutting profile of the first longitudinal blade 303 may differ from a cutting profile of the second longitudinal blade 304. As used herein, the term "cutting profile" may refer to dimensions, e.g., height, width, depth, cutter position, contours, other features, or combinations of the foregoing, of one or more portions of cutting edges formed on a cutter block.

Moreover, as discussed herein, the first longitudinal blade 303 may be circumferentially offset from the second longitudinal blade 304. In at least some embodiments, if the first longitudinal blade 303 is circumferentially offset from the second longitudinal blade 304, both the first longitudinal blade 303 and the second longitudinal blade 304 may extend along a length of the cutter block 301, and at least a portion of each of the first longitudinal blade 303 and the second longitudinal blade 304 may not intersect or may have different lateral or radial positions.

Figure 3B:
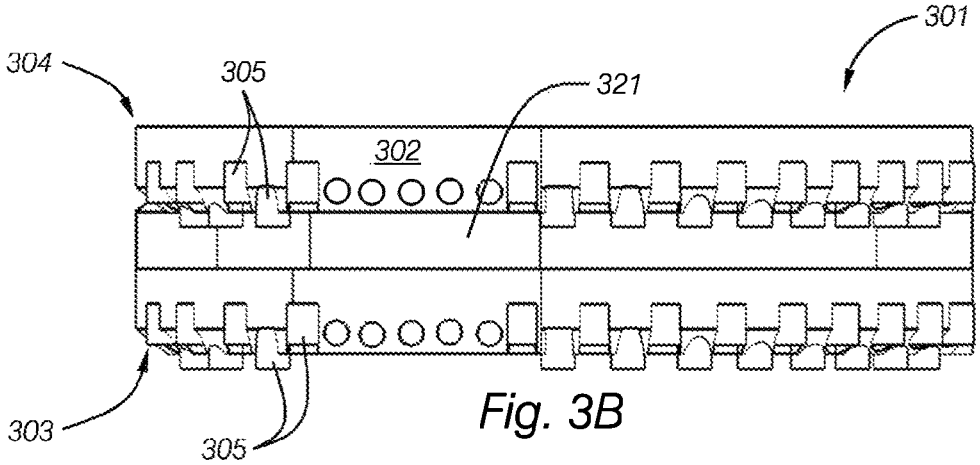
FIG. 3B is a top view of a cutter block in accordance with embodiments disclosed herein.

In one or more embodiments, a fluid flow channel 321 may be formed between the first longitudinal blade 303 and the second longitudinal blade 304 along a full or partial length of the cutter block 301. Referring to FIG. 3B, a top view of the cutter block 301 is shown in accordance with embodiments of the present disclosure. As shown, a flow channel 321 may be formed along a length of the cutter block 301 and may provide a path for cuttings and fluids to flow past longitudinal blades 303, 304 and the cutter block 301, thereby allowing for the evacuation of cuttings, as well as allowing fluid to lubricate and cool cutting elements 305. The flow channel 321 may be a recess formed in the body 302 of the cutter block 301, and may continue along an entire or partial length of the cutter block 301.

According to another aspect of the disclosure, there is provided a method of drilling a well bore, the method including tripping a drilling tool assembly, e.g., the BHA 18 shown in FIG. 1A, into a well bore. The drilling tool assembly may include a drill bit, e.g., the drill bit 20 shown in FIG. 1A, and a downhole cutting apparatus, e.g., the expandable tool 500 shown in FIGS. 1B and 1C. The downhole cutting apparatus may include at least one cutter block having at least one longitudinal blade, e.g., the longitudinal blade 203 shown in FIG. 2A. The at least one longitudinal blade may include a first cutting edge, e.g., the first cutting edge A in FIG. 2A or FIG. 3A, adjacent a second cutting edge, e.g., the second cutting edge B in FIG. 2A or FIG. 3A. In one or more embodiments, the first cutting edge and the second cutting edge may both be either underreaming cutting edges or backreaming cutting edges, or may both include underreaming and backreaming cutting edges.

The method may also include actuating the drill bit and drilling a first portion of the well bore with the drill bit. A second portion of the well bore may be drilled with the downhole cutting apparatus. As discussed herein, in one or more embodiments, a first cutting edge of a cutter block may include an underreaming cutting edge and a backreaming cutting edge, and the second cutting edge of the cutter block may also include an underreaming cutting edge and a backreaming cutting edge. As such, in one or more embodiments, drilling a second portion of the well bore with the downhole cutting apparatus may include drilling the second portion of the well bore with the underreaming cutting edge of the first cutting edge of the cutter block of the downhole cutting apparatus, with the backreaming cutting edge of the first cutting edge, or with both the underreaming or backreaming cutting edges of the first cutting edge.

The method may also include drilling a third portion of the well bore with the cutting edge of the second cutting edge of the cutter block of the downhole cutting apparatus after failure of the cutting edge of the first cutting edge of the cutter block of the downhole cutting apparatus. The third portion may include fully or partially drilling the third portion of the well bore with an underreaming cutting edge of the first cutting edge. The same or other methods may include fully or partially drilling the third portion of the well bore a backreaming cutting edge of the first cutting edge of the cutter block of the downhole cutting apparatus. The method may also include drilling a fourth portion of the well bore with the a second cutting edge of the cutter block of the downhole cutting apparatus (e.g., an underreaming and/or backreaming cutting edge) after failure of the first cutting edge of the first cutting edge of the cutter block of the downhole cutting apparatus.

According to another aspect of the disclosure, there is provided a method of manufacturing a cutter block, the method including forming a cutter block body having a longitudinal blade having a longitudinal axis defined therethrough (e.g., cutter blocks such as those shown in FIGS. 2A and 3A). In one or more embodiments, the longitudinal blade may include a first cutting edge optionally adjacent a second cutting edge. The first cutting edge and the second cutting edge may both be underreaming cutting edges, may both be backreaming cutting edges, or may both include underreaming and backreaming cutting edges In one or more embodiments, both the first cutting edge and the second cutting edge have a plurality of cutting element pockets formed therein for receiving cutting elements.

Cutting element pockets may include indentations formed into a surface of the cutter block 201, e.g., on the first cutting edge and/or the second cutting edge, and which are configured to receive and retain cutting elements, e.g., cutting elements 205, 206, 305. As shown in FIG. 2A, the cutting elements 205, 206 may be coupled to the cutter block 201 by being positioned in cutting element pockets formed in the first cutting edge and the second cutting edge, respectively. Coupling the cutting elements to the cutter block in the cutting element pockets may include brazing the cutting elements into the cutting element pockets. Coupling the cutting elements to the cutter block may also be done in other manners, such as without brazing. For example, the plurality of cutting elements, as disclosed herein, may be mechanically locked within the cutting element pockets, or in any other manner known in the art.

Further, as discussed herein, at least a portion of a first cutting edge may be radially outward of a second cutting edge relative to a longitudinal axis of the cutter block (see FIG. 2A). As discussed herein, the second cutting edge may be circumferentially offset from the first cutting edge. Further, in one or more embodiments, forming the cutter block may further include forming at least one stabilizer pad on the first longitudinal blade. The method may also include forming a second longitudinal blade on the cutter block, e.g., the second longitudinal blade 304 shown in FIG. 3A, and forming at least one stabilizer pad on the second longitudinal blade. The stabilizer pad may be located at an uphole end, downhole end, or intermediate position of a longitudinal blade. The stabilizer pad may intersect one or more blades and/or one or more cutting edges.

The method may also include coupling at least one depth of cut limiter to a stabilizer pad. As discussed herein regarding cutting elements and cutting element pockets, coupling at least one depth of cut limiter to the stabilizer pad may include brazing the depth of cut limiters into depth of cut pockets. Coupling at least one depth of cut limiter to a stabilizer pad is not, however, limited to brazing. For example, at least one depth of cut limiter may be mechanically coupled to a stabilizer pad, or may otherwise be coupled to the stabilizer pad by using any manner known in the art.

It should be understood that while elements are described herein in relation to depicted embodiments, each element may be combined with other elements of other embodiments. For example, the elements or cutting profile depicted in or described in relation to FIG. 2A, may be combinable with any elements or cutting profile depicted in FIGS. 1B, 1C, 3A, and 3B. Similarly, the elements depicted in or described in relation to FIGS. 2A and 2B may be combinable with any elements depicted in or described in relation to other figures.

While embodiments of movable arms and cutter blocks have been primarily described with reference to well bore drilling operations, the devices described herein may be used in applications other than the drilling of a well bore. In other embodiments, movable arms and cutter blocks according to the present disclosure may be used outside a well bore or other downhole environment used for the exploration or production of natural resources. For instance, tools and assemblies of the present disclosure may be used in a well bore used for placement of utility lines, or other industries (e.g., aquatic, manufacturing, automotive, etc.). Accordingly, the terms "well bore," "borehole" and the like should not be interpreted to limit tools, systems, assemblies, or methods of the present disclosure to any particular industry, field, or environment.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value. Where a range of values includes various upper and/or lower limits, any two values may define the bounds of the range, or any single value may define an upper limit (e.g., up to 50%) or a lower limit (at least 50%).

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements. It should be understood that "proximal," "distal," "uphole," and "downhole" are relative directions. As used herein, "proximal" and "uphole" should be understood to refer to a direction toward the surface, rig, operator, or the like. "Distal" or "downhole" should be understood to refer to a direction away from the surface, rig, operator, or the like.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A method of drilling a well bore, comprising:

tripping a drilling tool assembly having a longitudinal axis into a well bore, the drilling tool assembly including:

a drill bit; and a downhole cutting apparatus that includes at least one cutter block having a longitudinal blade, the longitudinal blade including a first cutting edge that includes a first plurality of cutting elements and a second cutting edge that includes a second plurality of cutting elements, the second cutting edge being circumferentially adjacent to the first cutting edge, and wherein a plane extending radially from the longitudinal axis through the longitudinal blade intersects at least a first cutting element of the first plurality of cutting elements and at least a second cutting element of the second plurality of cutting elements;

drilling a first portion of the well bore with the drill bit; and drilling a second portion of the well bore with the downhole cutting apparatus.

2. The method of claim 1, wherein drilling the second portion of the well bore with the downhole cutting apparatus includes drilling the second portion of the well bore with the first cutting edge of the cutter block.

3. The method of claim 2, further comprising:

drilling a third portion of the well bore with the second cutting edge after failure of the first cutting edge.

4. The method of claim 3, the cutter block including a third cutting edge, and the method further comprising:

drilling a fourth portion of the well bore with the third cutting edge after failure of the second cutting edge.

5. A method of manufacturing a cutter block, comprising:

forming a cutter block body having first and second cutting edges on a same longitudinal blade, the cutter block body including a first plurality of cutting element pockets formed along the first cutting edge and a second plurality of cutting element pockets formed along the second cutting edge, the first cutting edge circumferentially offset from the second cutting edge; and coupling a first plurality of cutting elements to the cutter block body and within the first plurality of cutting element pockets and a second plurality of cutting elements to the second plurality of cutting element pockets, the first plurality of cutting elements partially circumferentially overlapping the second plurality of cutting elements.

6. The method of claim 5, the second cutting edge being circumferentially offset from the first cutting edge.

7. The method of claim 5, wherein forming the cutter block body further includes forming a stabilizer pad on the same longitudinal blade.

8. The method of claim 7, further comprising:

coupling at least one depth of cut limiter to the stabilizer pad.

9. The method of claim 7, wherein forming the cutter block body includes forming an apex of the first cutting edge on or proximate a first portion of the stabilizer pad.

10. The method of claim 9, wherein forming the cutter block body includes forming an apex of the second cutting edge on or proximate a second portion of the stabilizer pad.

11. The method of claim 10, wherein forming the stabilizer pad includes forming the stabilizer pad as at least a portion of the first or second cutting edge, and an apex of the first or second cutting edge being defined by an outer surface of the stabilizer pad.

12. The method of claim 5, wherein forming the cutter block body includes forming the first cutting edge radially outward from the second cutting edge.

13. A downhole cutting apparatus, comprising:

a cutter block having a longitudinal blade, the longitudinal blade including:

a first cutting edge; and a second cutting edge adjacent the first cutting edge, a first radial position of the first cutting edge at a longitudinal position being radially outward of a second radial position of the second cutting edge at the longitudinal position, the first cutting edge at least partially circumferentially overlapping the second cutting edge, the first and second cutting edges each including:

an underreaming cutting edge;

a backreaming cutting edge; or an underreaming cutting edge and a backreaming cutting edge.

14. The apparatus of claim 13, the first cutting edge including one or more cutting elements and the second cutting edge including one or more cutting elements, the one or more cutting elements of the second edge being positioned between the one or more cutting elements of the first cutting edge.

15. The apparatus of claim 13, the first cutting edge including one or more cutting elements and the second cutting edge including one or more cutting elements, the cutting elements of the first cutting edge being different from the cutting elements of the second cutting edge in at least one of:

size;

shape; or material make-up.

16. The apparatus of claim 13, the longitudinal blade including a stabilizer pad, and an apex of at least one of the first or second cutting edge being located on or proximate the stabilizer pad.

17. The apparatus of claim 13, the first cutting edge having an apex of a height that is substantially equal to a height of an apex of the second cutting edge.

18. The apparatus of claim 13, the cutter block having a second longitudinal blade, the second longitudinal blade including:

a third cutting edge; and a fourth cutting edge adjacent the first cutting edge, the first and second cutting edges each including:

an underreaming cutting edge;

a backreaming cutting edge; or an underreaming cutting edge and a backreaming cutting edge.

19. The apparatus of claim 13, at least a portion of the first cutting edge being circumferentially offset from the second cutting edge.

20. The apparatus of claim 13, the first cutting edge including one or more cutting elements and the second cutting edge including one or more cutting elements, wherein a plane extending radially from the longitudinal axis through the longitudinal blade intersects at least a first cutting element of the first plurality of cutting elements and at least a second cutting element of the second plurality of cutting elements.

* * * * *